US006030751A

United States Patent [19]

Ellis et al.

[11] Patent Number: 6,030,751

[45] **Date of Patent: *Feb. 29, 2000**

[54] PRINTING WITH SELF-CLEANING, ABRASION-RESISTANT, LASER-IMAGEABLE LITHOGRAPHIC PRINTING CONSTRUCTIONS

[75] Inventors: Ernest W. Ellis, Harvard; Frederick R. Kearney, Walpole, both of Mass.

[73] Assignee: Presstek, Inc., Hudson, N.H.

[ * ] Notice: This patent is subject to a terminal disclaimer.

[21] Appl. No.: 09/139,508

[22] Filed: Aug. 25, 1998

Related U.S. Application Data

[63] Continuation of application No. 08/756,267, Nov. 25, 1996, Pat. No. 5,807,658, which is a continuation-in-part of application No. 08/700,287, Aug. 20, 1996, Pat. No. 5,783,364.

[51] Int. Cl.[7] ..... B41N 1/14

[52] U.S. Cl. ..... 430/302; 430/300; 430/201; 430/945; 430/200; 101/457; 101/467

[58] Field of Search ..... 101/457, 454, 101/467; 430/302, 200, 201, 945, 300

[56] References Cited

U.S. PATENT DOCUMENTS

| | | | |
|---|---|---|---|
| 5,061,607 | 10/1991 | Walls | 430/302 |
| 5,379,698 | 1/1995 | Nowak et al. | 101/457 |
| 5,493,971 | 2/1996 | Lewis et al. | 101/457 |
| 5,506,086 | 4/1996 | Van Zoeren | 430/201 |
| 5,506,090 | 4/1996 | Gardner, Jr. et al. | 430/302 |
| 5,677,110 | 10/1997 | Chia et al. | 430/302 |
| 5,691,063 | 11/1997 | Davis et al. | 428/411.1 |
| 5,783,364 | 7/1998 | Ellis et al. | 430/302 |
| 5,786,090 | 7/1998 | Fisher et al. | 428/411.1 |
| 5,807,658 | 9/1998 | Ellis et al. | 101/457 |

*Primary Examiner*—Martin Angebranndt
*Attorney, Agent, or Firm*—Cesari and McKenna, LLP

[57] ABSTRACT

Lithographic printing is accomplished using wet lithographic printing plates that include a protective layer providing protection against handling and environmental damage, extension of plate shelf life, and entrainment of debris generated by ablation. The layer washes away during the printing make-ready process, effectively cleaning the plate and disappearing without the need for a separate removal process.

11 Claims, 1 Drawing Sheet

PRINTING WITH SELF-CLEANING, ABRASION-RESISTANT, LASER-IMAGEABLE LITHOGRAPHIC PRINTING CONSTRUCTIONS

RELATED APPLICATION

This is a continuation of U.S. Ser. No. 08/756,267, Nov. 25, 1996, now U.S. Pat. No. 5,807,658, which is itself a continuation-in-part of U.S. Ser. No. 08/700,287, Aug. 20, 1996, now U.S. Pat. No. 5,783,364.

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

Traditional techniques of introducing a printed image onto a recording material include letterpress, flexographic and gravure printing, and offset lithography. All of these printing methods require a printing member, usually loaded onto or integral with a plate cylinder of a rotary press for efficiency, to transfer ink in the pattern of the image. In letterpress and flexographic printing, the image pattern is represented on the printing member in the form of raised areas that accept ink and transfer it onto the recording medium by impression; flexographic systems, which utilize elastomeric surfaces, have received more widespread acceptance due to the broad variety of compatible substrates and the ability to run with fluid inks. Gravure printing cylinders, in contrast to raised-surface systems, contain series of wells or indentations that accept ink for deposit onto the recording medium; excess ink must be removed from the cylinder by a doctor blade or similar device prior to contact between the cylinder and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording material; the plate first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to or in conjunction with inking. The ink-repellent fountain solution prevents ink from adhering to the non-image areas, but does not affect the oleophilic character of the image areas.

If a press is to print in more than one color, a separate printing plate corresponding to each color is required. Such plates have traditionally been imaged off-press, using a photographic process. In addition to preparing the appropriate plates for the different colors, the operator must mount the plates properly on the plate cylinders of the press, and coordinate the positions of the cylinders so that the color components printed by the different cylinders will be in register on the printed copies. Each set of cylinders associated with a particular color on a press is usually referred to as a printing station.

Photographic platemaking processes tend to be time-consuming and require facilities and equipment adequate to support the necessary chemistry. To circumvent these shortcomings, practitioners have developed a number of electronic alternatives to plate imaging. With these systems, digitally controlled devices alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or ink-accepting spots on plate blanks; and spark-discharge equipment, in which an electrode in contact with or spaced close to a plate blank produces electrical sparks to physically alter the topology of the plate blank, thereby producing "dots" which collectively form a desired image (see, e.g., U.S. Pat. No. 4,911,075).

U.S. Pat. Nos. 5,339,737 and 5,379,698, the entire disclosures of which are hereby incorporated by reference, disclose a variety of lithographic plate configurations for use with imaging apparatus that operate by laser discharge (see, e.g., U.S. Pat. No. 5,385,092 and allowed U.S. application Ser. No. 08/376,766). These include "wet" plates that utilize fountain solution during printing, and "dry" plates to which ink is applied directly. These plates may be imaged on a stand-alone platemaker or directly on-press.

In the former case, although the most cumbersome aspects of traditional platemaking are avoided, plates must be manually (and sequentially) loaded onto the platemaker, imaged, inspected, then transferred to the press and mounted to their respective plate cylinders. This involves a substantial amount of handling that can damage the plate, which is vulnerable—both before and after it is imaged—to damage from abrasion. Indeed, even fingerprints can interfere with plate performance by altering the affinity characteristics of the affected areas.

The ability to image on-press obviously reduces the possibility of handling damage substantially, but does not eliminate it. Plates must still be removed from their packaging and mounted to the press; in the case of ablation-type plates, it is frequently necessary to clean the plates to remove imaging debris, an operation that can result in abrasion if performed improperly. Indeed, lithographic printing plates can suffer damage even without handling: airborne debris, environmental contamination, movement of the packaged plates and the mere passage of time can inflict various stresses that interfere with ultimate plate performance.

To protect the plate during packaging, shipment and use, manufacturers may add a peelable barrier sheet to the final construction. As discussed, for example, in the '737 patent, this layer adheres to the surface of the plate, protecting it against damage and environmental exposure, and may be removed following imaging. Unfortunately, this sheet can itself damage the plate if the degree of adhesion is inappropriate or if carelessly removed, and in any case adds cost to the plate and its removal imposes an additional processing step.

DESCRIPTION OF THE INVENTION

BRIEF SUMMARY OF THE INVENTION

In accordance with the invention, wet lithographic printing plates are provided with a protective layer that serves a variety of beneficial functions: first, the layer provides protection against handling and environmental damage, and also extends plate shelf life, but washes away during the printing make-ready process; second, the protective layer performs a cleaning function, entraining debris and carrying it away as the layer itself is removed; third, if the layer immediately beneath the protective layer is ablated during the imaging process, the protective layer acts as a barrier, preventing the emergence of airborne debris that might interfere with imaging optics; and finally, the protective layer exhibits hydrophilicity (as that term is used in the printing industry, i.e., accepting fountain solution), actually accelerating plate "roll-up"—that is, the number of preliminary impressions necessary to achieve proper quality of the printed image. Because the protective layer of the present invention performs these functions but disappears in the course of the normal "make-ready" process that includes roll-up—indeed, even accelerates that process—its value to the printing process is substantial.

In one embodiment, the protective layer is applied to lithographic printing plates having surface layers based on certain metallic inorganic materials. These materials are both hydrophilic and very durable, making them desirable for wet-plate constructions. Because they exhibit satisfactory durability even at very small deposition thicknesses, the amount of debris produced by the imaging process is minimal, so the protective layer can be quite thin. The metallic inorganic layers may be conveniently applied by vacuum coating techniques. These layers are readily removable by, for example, laser imaging radiation, and the protective layer preserves their hydrophilic character during storage.

These ablation-type plates preferably absorb at imaging wavelengths in the IR, and preferably near-IR region; as used herein, "near-IR" means imaging radiation whose $lambda_{max}$ lies between 700 and 1500 nm. An important feature of the present invention is its usefulness in conjunction with solid-state lasers (commonly termed semiconductor diode lasers, these include devices based on gallium aluminum arsenide compounds and single-crystal lasers (e.g., Nd:YAG and Nd:YLF) that are themselves diode-laser- or lamp-pumped) as sources of imaging radiation; these are distinctly economical and convenient, and may be used in conjunction with a variety of imaging devices. The use of near-IR radiation facilitates use of a wide range of organic and inorganic absorption materials.

The protective layer of the present invention may also be advantageously applied to other ablation-type or laser-etch wet plates having radiation-responsive surfaces, as contemplated, for example, in U.S. Pat. No. 4,214,249 (Kasai et al.) and U.S. Pat. No. 4,054,094 (Caddell et al.), the entire disclosures of which are hereby incorporated by reference.

It should be stressed that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

The protective layer is essentially a thin, water-responsive overcoat. Preferably, the material comprises a polyalkyl ether compound with a molecular weight appropriate to the mode of application, and may also contain thickeners or other modifiers to assist with deposition or to achieve desired final properties.

BRIEF DESCRIPTION OF THE DRAWINGS

The foregoing discussion will be understood more readily from the following detailed description of the invention, when taken in conjunction with the accompanying drawings, in which.

Figure 1:
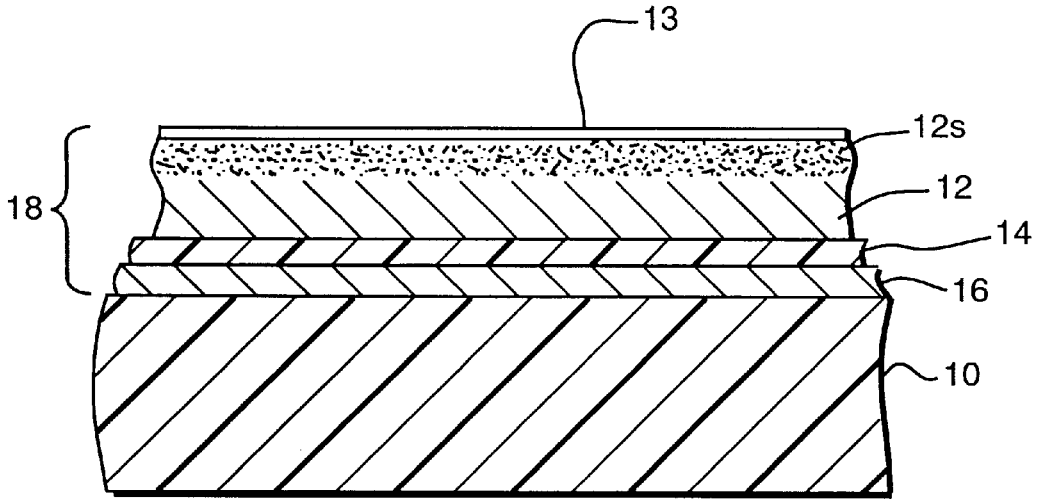
FIG. 1 is an enlarged sectional view of a general recording construction having at least a substrate and, disposed thereon, a laser-ablatable metal having an oxide surface, and optionally an optical interference structure.

The drawings and components shown therein are not necessarily to scale.

DETAILED DESCRIPTION OF THE PREFERRED EMBODIMENTS

1. Protective Layer Compositions

The material forming the protective layer preferably comprises a polyalkyl ether compound with a molecular weight that depends on the mode of application and the conditions of plate fabrication. For example, when applied as a liquid, the polyalkyl ether compound may have a relatively substantial average molecular weight (i.e., at least 600) if the plate undergoes heating during fabrication or experiences heat during storage or shipping; otherwise, lower molecular weights are acceptable. A coating liquid should also exhibit sufficient viscosity to facilitate even coating at application weights appropriate to the material to be coated.

A preferred formulation for aqueous coating comprises 80 wt % polyethylene glycol (PEG) with an average molecular weight of about 8000 combined with 20 wt % hydroxypropyl cellulose to serve as a thickener. A formulation according to this specification was prepared by combining 4.4 parts by weight ("pbw") of Pluracol 8000 (supplied by BASF, Mt. Olive, N.J.) with 1.1 pbw of Klucel G or 99-G "FF" grade hydroxypropyl cellulose (supplied by the Aqualon division of Hercules Inc., Wilmington, Del.). The ingredients were blended together as dry powders and the mixture slowly added to 28 pbw of water at 50–55° C. with rapid agitation, allowing the powders to be wetted between additions. The mixture were stirred for 20–30 min. while maintaining the temperature between 50–55° C., thereby wetting the Klucel particles and dissolving the Pluracol. At this point 66.5 pbw of cold water (ca. 5–10° C.) was added all at once, bringing the mixture temperature close to or below room temperature. Stirring was continued for 1–2 hours until solution was complete. The fluid viscosity was measured at about 100 cp.

Other materials and formulations can be used to advantage. For example, the polyalkyl ether can be replaced with a polyhydroxyl compound, a polycarboxylic acid, a polysulfonamide or a polysulfonic acid or mixtures thereof. Gum arabic or the gumming agents found in commercial plate finishers and fountain solutions can also be used to provide the protective layer. The TRUE BLUE plate cleaning material and the VARN TOTAL fountain solution supplied by Varn Products Company, Oakland, N.J. are also suitable for this purpose, as are the FPC product from the Printing Products Division of Hoescht Celanese, Somerville, N.J., the G-7A-"V"-COMB fountain solution supplied by Rosos Chemical Co., Lake Bluff, Ill., the VANISH plate cleaner and scratch remover marketed by Allied Photo Offset Supply Corp., Hollywood, Fla., and the POLY-PLATE plate-cleaning solution also sold by Allied. Still another useful finishing material is polyvinyl alcohol, applied as a very thin layer.

The protective layer 13 is preferably applied at a minimal thickness consistent with its roles, i.e., providing protection against handling and environmental damage, extending plate shelf life by shielding the plate from airborne contaminants, and entraining debris produced by imaging. The thinner layer 13 can be made, the more quickly it will wash off during press make-ready, the shorter will be the roll-up time, and the less the layer will affect the imaging sensitivity of the plate.

2. Plate Constructions

Refer first to FIG. 1, which illustrates a first embodiment of the present invention. The depicted plate construction includes, in its most basic form, a substrate 10 and a surface layer 12. Substrate 10 is preferably strong, stable and flexible, and may be a polymer film, or a paper or thermally insulated metal sheet. Polyester films (in a preferred embodiment, the MYLAR film sold by E.I. duPont de Nemours Co., Wilmington, Del., or the MELINEX film sold by ICI Films) furnish useful examples. A preferred polyester-film thickness is 0.007 inch, but thinner and thicker versions can be used effectively.

Paper substrates are typically "saturated" with polymerics to impart water resistance, dimensional stability and strength. Aluminum is a preferred metal substrate. Ideally, the aluminum is polished so as to reflect any imaging radiation penetrating any overlying optical interference layers. One can also employ, as an alternative to a metal reflective substrate 10, a layer containing a pigment that reflects imaging (e.g., IR) radiation. A material suitable for use as an IR-reflective substrate is the white 329 film supplied by ICI Films, Wilmington, Del., which utilizes IR-reflective barium sulfate as the white pigment. A preferred thickness is 0.007 inch, or 0.002 inch if the construction is laminated onto a metal support as described hereinbelow.

Layer 12 is a very thin (50–500 Å, with 300 Å preferred for titanium) layer of a metal that may or may not develop a native oxide surface 12*s* upon exposure to air. This layer ablates in response to IR radiation. The metal or the oxide surface thereof exhibits hydrophilic properties that provide the basis for use of this construction as a lithographic printing plate. Imagewise removal, by ablation, of layers 12/12*s* and 13 exposes underlying layer 10, which is oleophilic; accordingly, while layers 12/12*s* and 13 accept fountain solution, layer 10 rejects fountain solution but accepts ink. Complete ablation of layer 12 (layer 13 will wash off during press make-ready) is therefore important in order to avoid residual hydrophilic metal in an image feature.

The metal of layer 12 is at least one d-block (transition) metal, aluminum, indium or tin. In the case of a mixture, the metals are present as an alloy or an intermetallic. Again, the development, on more active metals, of an oxide layer can create surface morphologies that improve hydrophilicity. Such oxidation can occur on both metal surfaces, and may also, therefore, affect adhesion of layer 12 to substrate 10 (or other underlying layer). Substrate 10 can also be treated in various ways to improve adhesion to layer 12. For example, plasma treatment of a film surface with a working gas that includes oxygen (e.g., an argon/oxygen mix) results in the addition of oxygen to the film surface, improving adhesion by rendering that surface reactive with the metal(s) of layer 12. Oxygen is not, however, necessary to successful plasma treatment. Other suitable working gases include pure argon, pure nitrogen, and argon/nitrogen mixtures. See, e.g., Bernier et al., ACS Symposium Series 440, Metallization of Polymers, p. 147 (1990).

If layer 12 is partially reflective, two additional layers 14, 16 can be added to this construction and which, when combined with layer 12, form an optical interference structure 18. Ignition of layer 12 burns away intermediate layers 14, 16. Layer 14 is a quarter-wave dielectric spacer whose thickness depends, as set forth above, on the wavelength of interest. A thickness between 0.05 and 0.9 $\mu$m produces a visible contrast color. This layer is ordinarily polymeric, and is preferably a polyacrylate. Suitable polyacrylates include polyfunctional acrylates or mixtures of monofunctional and polyfunctional acrylate that may be applied by vapor deposition of monomers followed by electron-beam or ultraviolet (UV) cure.

Layer 16 is a reflective layer, e.g., aluminum of thickness ranging from 50 to 500 Å (or thicker, if feasible given laser power output and the need for complete ablation). Layers 12, 14 and 16 can all be deposited under vacuum conditions. In particular, layers 12 and 16 may be deposited by vacuum evaporation or sputtering (e.g., with argon); in the case of layer 16, it is preferred to vacuum sputter onto a plasma-treated polyester substrate 10. Layer 14 can be applied by vapor deposition; for example, as set forth in U.S. Pat. Nos. 4,842,893 and 5,032,461 (the entire disclosures of which are hereby incorporated by reference), low-molecular-weight monomers or prepolymers can be flash vaporized in a vacuum chamber, which also contains a web of material (e.g., a suitably metallized substrate 10) to be coated. The vapor is directed at the surface of the moving web, which is maintained at a sufficiently low temperature that the monomer condenses on its surface, where it is then polymerized by exposure to actinic radiation. Ordinarily, the monomers or prepolymers have molecular weights in the range of 150–800.

The material of layer 13 is coated as an aqueous fluid to yield, when dry, a layer of acceptable thickness. In the present embodiment, the PEG/hydroxypropyl cellulose formulation set forth above may be applied by offset gravure coating as a 5.5%-solids aqueous fluid to an application thickness yielding a dry weight ranging from 0.05 to 0.5 g/m (and ideally from 0.1 to 0.2 g/m ); drying can occur, for example, at 80° C. This coating thickness, when applied to the titanium nitride surface of a plate structure having this surface over a polyester substrate, was found to provide an acceptable level of scratch resistance for prepress handling, and facilitated complete on-press removal of imaging debris during roll-up without a separate cleaning step.

Other suitable coating techniques include reverse gravure, slot-die and extrusion. Alternatively, layer 13 can be deposited as a vapor, in which case the viscosity of the material less relevant. More important is the overall hydrophilicity of the final layer.

Figure 2:
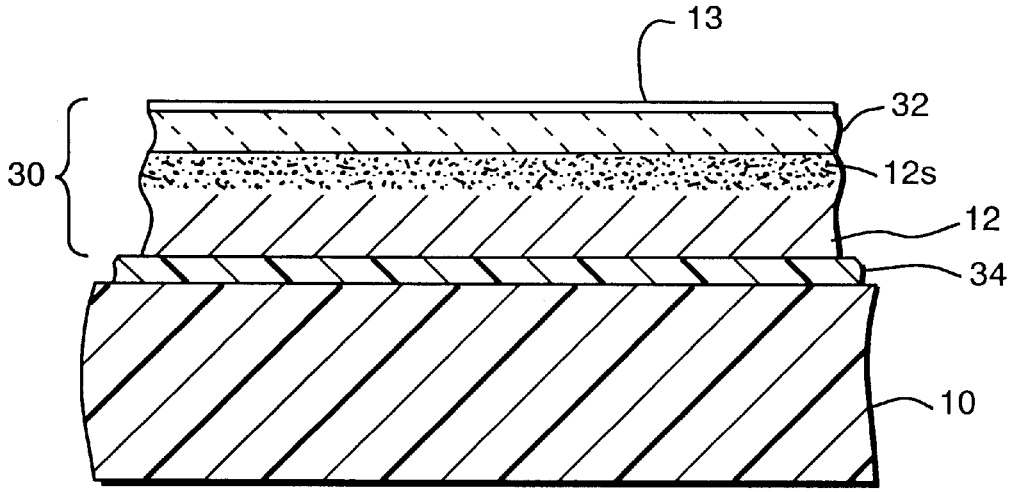
FIG. 2 is an enlarged sectional view of another general recording construction having a substrate and, disposed thereon, a laser-ablatable, inorganic metallic layer that may optionally form part of an optical interference structure.

Refer now to FIG. 2, which illustrates a second embodiment of the invention, in which a hard, durable, hydrophilic layer 32 is disposed directly above layer 10 or, more preferably, above a metal layer 12, since addition of the latter tends to improve overall adhesion. In the latter case, layer 12 may or may not contain an oxide interface 12*s*. Layer 13 is applied over layer 32.

Layer 32 is a metallic inorganic layer comprising a compound of at least one metal with at least one non-metal, or a mixture of such compounds. Along with underlying layer 12/12*s*, layer 32 ablatively absorbs imaging radiation, and consequently is applied at a thickness of only 100–2000 Å. Accordingly, the choice of material for layer 32 is critical, since it must serve as a printing surface in demanding commercial printing environments, yet ablate in response to imaging radiation. This approach is therefore distinct from the multilayer constructions disclosed in U.S. Pat. No. 5,354,633, which is directed toward blockage of actinic radiation rather than function as a printing plate. As a result, the constructions of the '633 patent require a thick series of layers that do not respond uniformly to imaging radiation. Instead, only the top layer or layers actually ablate in response to imaging radiation; this layer or layers, in turn, cause ignition of the underlying opaque layer, which is destroyed as a result of that ignition and not the action of the laser beam.

The metal component of layer 32 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 32 may be one or more of the p-block elements boron, carbon, nitrogen, oxygen and silicon. A metal/non-metal compound in accordance herewith may or may not have a definite stoichiometry, and may in some cases (e.g., Al—Si compounds) be an alloy. Preferred metal/non-metal combinations include TiN, TiON, $TiO_x$ (where $0.9 \leqq x \leqq 2.0$), TiAlN, TiAlCN, TiC and TiCN.

Certain species are not suited to use in layer 32. These include the chalcogenides, sulfur, selenium and tellurium; the metals antimony, thallium, lead and bismuth; and the elemental semiconductors silicon and germanium present in proportions exceeding 90% of the material used for layer 32; and compounds including arsenic (e.g., GaAs, GaAlAs, GaAlInAs, etc.). These elements fail in the context of the present invention due to poor durability, absence of hydrophilicity, chemical instability and/or environmental and toxicity concerns. The primary considerations governing the choice of material are performance as an optical interference construction (if desired), adhesion to adjacent layers, ablation response, the absence of toxic materials upon ablation, and the economics of procurement and application. Generally, layer 32 is applied as a vacuum-coated thin film.

Once again, using the PEG/hydroxypropyl cellulose formulation, application (e.g., by offset gravure coating) as a 5.5%-solids aqueous fluid to an application thickness yielding a dry weight ranging from 0.05 to 0.5 $g/m^2$ (and ideally from 0.1 to 0.2 $g/m^2$) provides an adequately thick final coating.

To further reduce vulnerability to scratching, it may be helpful to add an underlying layer 34 harder than substrate 10. Layer 34 can be a polyacrylate, which may be applied under vacuum conditions as described above, or a polyurethane. A representative thickness range for layer 34 is 1–2 $\mu$m. In the case of a metal substrate 10, layer 34 can comprise a thermally insulating material that prevents dissipation of the imaging pulse into substrate 10, and which serves as a printing surface (exhibiting an affinity for ink and/or fountain solution different from the topmost surface).

It will therefore be seen that the foregoing approach can be used to protect a variety of laser-imageable graphic-arts constructions without disruption of processing, and to eliminate the need for separate cleaning action. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of printing comprising the steps of:

a. providing an ablation-type wet printing member comprising a topmost layer soluble in a fountain solution to which ink will not adhere, an imaging layer comprising a metal or a compound of a metal element with at least one non metallic element; and an ink-receptive layer;

b. creating a lithographic image on the printing member by selective exposure thereof, in a pattern representing an image, to imaging radiation so as to ablate the imaging layer but not the ink-receptive layer;

c. removing the topmost layer by applying, to the printing member, a fountain solution to which ink will not adhere, thereby exposing the imaging layer where not ablated; and d. printing with the imaged member by applying fountain solution to the printing member, the fountain solution adhering to the exposed imaging layer but not to the ink-receptive layer, and thereafter applying ink to the printing member, the ink being rejected by the adhered fountain solution.

2. The method of claim 1 wherein the imaging layer is hydrophilic.

3. The method of claim 1 wherein the topmost layer comprises at least one compound selected from the group consisting of polyalkyl ethers, polyhydroxyl compounds, polycarboxyl acids, polysulfonamides and polysulfonic acids.

4. The method of claim 3 wherein the topmost layer comprises polyethylene glycol.

5. The method of claim 4 wherein the polyethylene glycol has an average molecular weight is at least 600.

6. The method of claim 1 wherein the topmost layer further comprises a thickener.

7. The method of claim 6 wherein the thickener is hydroxypropyl cellulose.

8. The method of claim 1 wherein the imaging layer comprises a compound of at least one metal with at least one non-metal, the at least one non-metal being selected from the group consisting of boron, carbon, nitrogen, silicon and oxygen.

9. The method of claim 8 wherein the imaging layer comprises at least one of (i) a d-block transition metal, (ii) an f-block lanthanide, (iii) aluminum, (iv) indium and (v) tin.

10. The method of claim 8 wherein the imaging layer is titanium nitride and the ink-receptive layer is polyester.

11. The method of claim 1 wherein the topmost layer entrains imaging debris generated by ablation of the first layer.

* * * * *